United States Patent [19]

Cavaler

[11] 4,120,059

[45] Oct. 17, 1978

[54] FURNITURE SPRING ASSEMBLY AND METHOD FOR MANUFACTURE THEREOF

[76] Inventor: Paul Cavaler, 22698 Essex Way, Southfield, Mich. 48075

[21] Appl. No.: 790,286

[22] Filed: Apr. 25, 1977

[51] Int. Cl.[2] ..... A47C 23/02

[52] U.S. Cl. ..... 5/256; 5/267; 5/354; 5/351

[58] Field of Search ..... 5/248, 256, 260, 263, 5/267, 351, 354

[56] References Cited

U.S. PATENT DOCUMENTS

| | | | |
|---|---|---|---|
| 323,309 | 7/1885 | Flagler | 5/248 |
| 400,900 | 4/1889 | Davis | 5/248 |
| 2,300,718 | 11/1942 | Williams | 5/354 |
| 2,638,154 | 5/1953 | Dewees | 5/354 |
| 2,779,036 | 1/1957 | Platt | 5/354 |
| 3,783,459 | 1/1974 | Piliero | 5/263 |
| 3,916,464 | 11/1975 | Tyhanic | 5/351 |

*Primary Examiner*—Casmir A. Nunberg

*Attorney, Agent, or Firm*—Barnes, Kisselle, Raisch & Choate

[57] ABSTRACT

A mattress box spring comprising a plurality of substantially conical coil springs rigidly fastened at the spring ends of lesser diameter to a support frame such that the spring end coils of greater diameter lie in a substantially common plane, a wire mesh overlying the end coils in the common plane with the spring end coils being unattached or free-floating with respect to the mesh and with respect to each other, and a cloth cover or pad disposed over the mesh and having a periphery attached to the frame to hold the assembly together. Preferably, the diameter of each spring end coil lying in the common plane is greater than the corresponding spring height.

10 Claims, 2 Drawing Figures

FURNITURE SPRING ASSEMBLY AND METHOD FOR MANUFACTURE THEREOF

The present invention relates to spring assemblies for furniture, such as mattress box springs for example, and to methods for manufacture thereof.

In coil spring assemblies previously proposed, particularly mattress box spring assemblies of the type which include generally conical coil springs, one end of each of a plurality of spaced springs is fixedly attached to a rigid support such as a frame and the opposing spring ends are attached to each other by wires which form a relatively coarse mesh to hold the springs in spaced relation to each other and to prevent individual spring from toppling or collapsing in the lateral direction. Techniques for attaching the wire mesh to the springs, such as by means of a plurality of clips separate from or integral with the mesh wires as in Ciampa et al. U.S. Pat. No. 3,577,574, or by interweaving of the mesh wires with the spring ends as in Ciampa et al. U.S. Pat. No. 3,270,354, have proven to be relatively expensive as compared with the cost of the resulting spring assemblies as a whole. Moreover, the resulting assemblies are not completely satisfactory from the standpoints of comfort and durability.

Accordingly, objects of the present invention are to provide a spring assembly for furniture or the like which is easy and economical to assemble, and which is comfortable and durable in operation; to provide an economical method for manufacturing furniture spring assemblies; and, in particular, to provide an economical mattress box spring and a method for manufacture thereof.

Figure 1:
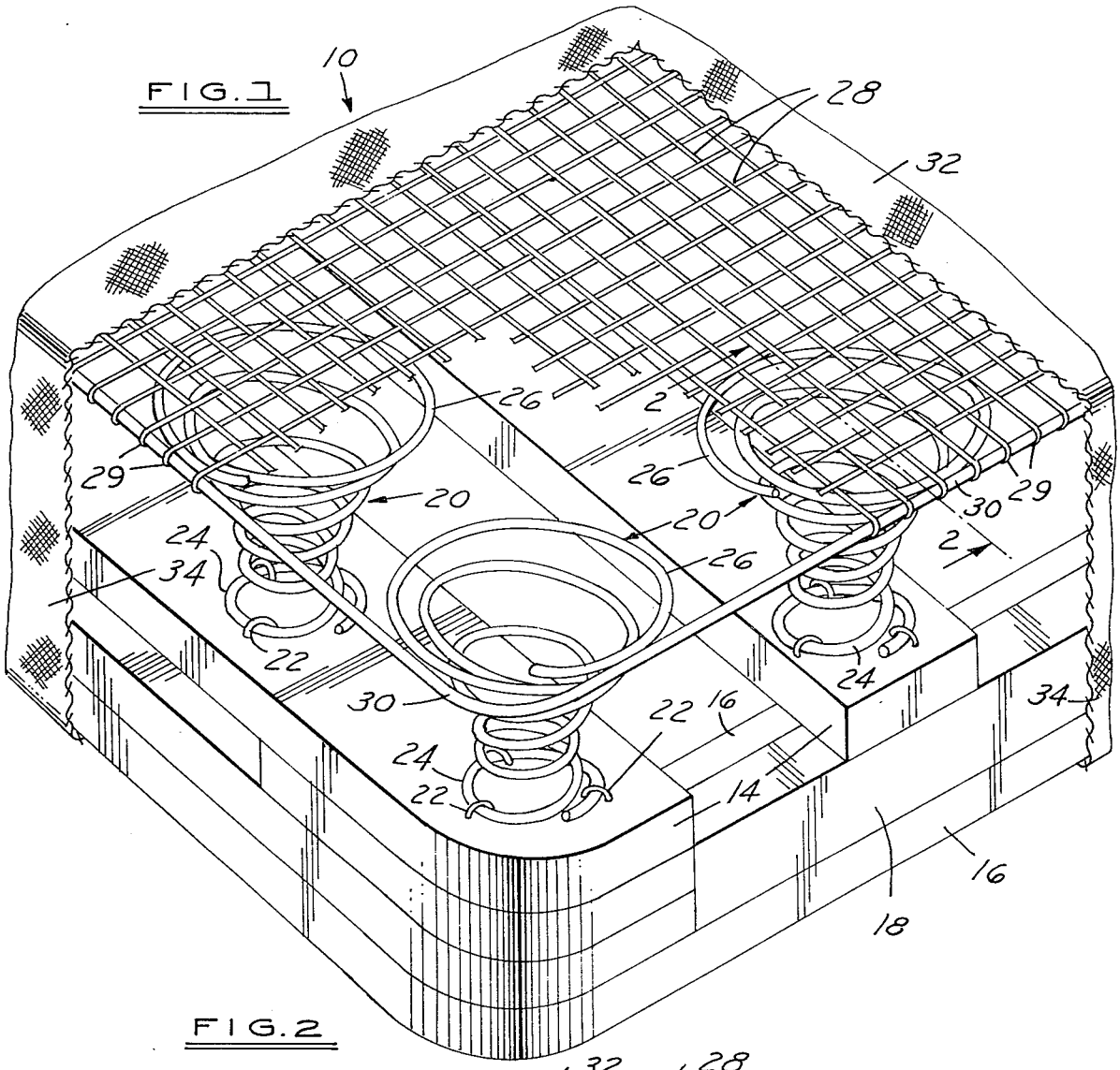
Figure 2:
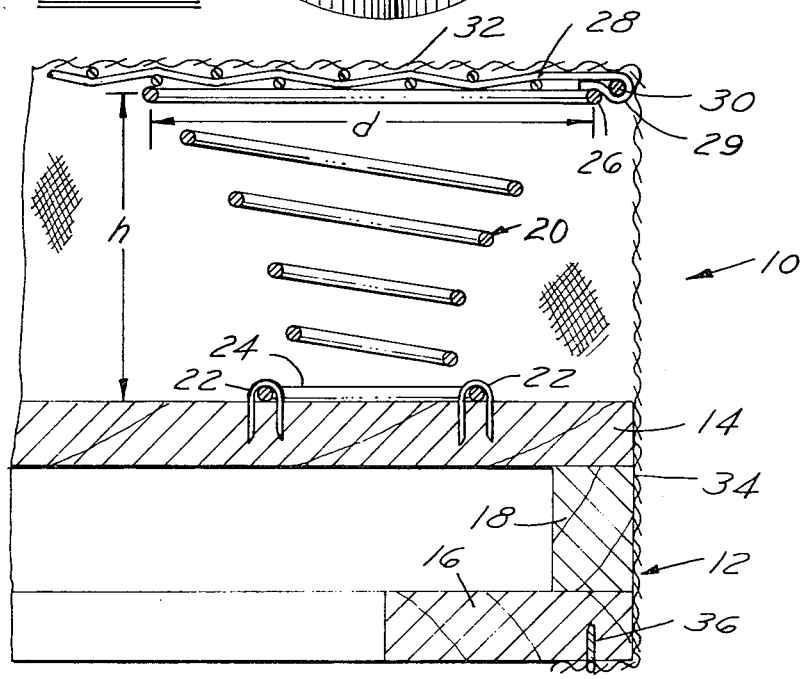

The invention, together with additional objects, features and advantages thereof, will be best understood from the following description when read in conjunction with the accompanying drawings in which:

FIG. 1 is a fragmentary, partially sectioned perspective view of a presently preferred embodiment of the invention as applied to mattress box springs; and FIG. 2 is a sectional view taken along the line 2—2 in FIG. 1.

Referring to the drawings, a mattress box spring 10 which embodies the principles of the invention comprises a frame 12 having a plurality of parallel wooden slats 14 nailed or otherwise affixed to a frame base 16 with a spacer element 18 or the like disposed therebetween. The number of and spacing between slats 14 depend upon the desired size and grade of mattress 10, as is conventional and well known in the art. A plurality of generally conical coil springs 20 are disposed in a rectilinear array of parallel rows and columns on frame 12, each spring 20 being rigidly affixed to a slat 14 by the staples 22 at the spring base or end coil 24 of lesser diameter. As best seen in FIG. 2, the diameter of spring base coil 24 is increased or flared as compared with the generally tapering diameter of the spring as a whole to facilitate attachment of staples 22. The spring upper end coils 26 of greater diameter lie in a substantially common plane. Only a corner segment of box spring 10 is shown in the drawings, it being understood that the construction hereinabove and hereinafter described is repeated as required to form a box spring of desired size.

In accordance with one important aspect of the invention, the diameter *d* (FIG. 2) of each upper end coil 26, which coincides with the maximum diameter of conical spring 20, is of a dimension which is at least equal to, and preferably is greater than the overall spring height *h*. In one presently preferred embodiment of the invention as applied to a mattress box spring construction which is illustrated to scale in the drawings, the spring height *h* is approximately equal to 4 inches and the maximum spring diameter *d* is approximately equal to 6 inches or 50 percent more than the spring height. This may be contrasted with typical prior art box spring constructions in which the above-noted height and diameter dimensions are reversed. In cooperation with the shorter and wider springs provided herein, it is presently preferred to fabricate springs 20 of relatively thick wire stock, as on the order of 10 gauge wire (0.135 inch diameter) or larger. The resulting springs are relatively stiff in the axial direction thereby to provide comfortable support, and at the same time inherently resist bending or toppling in the lateral direction when loaded. Spacers 18 compensate for the reduced height of springs 20 so that mattress 10 may possess standard overall outside dimensions.

A planar mesh 28 of woven spring wire or the like is bent at its generally rectangular periphery 29 around a border wire 30 and overlies springs 20 in the common plane of spring end coils 26 with border wire 30 being disposed above the periphery of frame 12. In accordance with another important feature of the invention, spring end coils 26 are unattached or free-floating with respect to mesh 28 and with respect to each other, i.e., are not positively connected to mesh 28 in any way. Because the shorter and wider configuration of springs 20 discussed hereinabove inherently resists lateral toppling, spring ends 26 need not be coupled to each other to maintain the desired spaced relationship therebetween as in the prior art, thereby eliminating a time-consuming and expensive step in the construction of mattress 10. The openings in mesh 28 are preferably substantially less than the diameter of spring end coil 26, the one inch grid of mesh 28 illustrated in the drawings being preferred. This relatively fine mesh not only eliminates support "holes" between the spring ends thereby to increase comfort and support, but also helps distribute the mattress load among the springs. Because of the present trend toward stiff box springs for enhanced sacral support, relatively thick wire for mesh 28, as on the order of 15 gauge wire (0.072 inch), is preferred.

A mattress cover and pad 32 overlies mesh 28 and has a periphery 34 which drapes over border wire 30 and is fastened by tacks 36 to frame base 16. Preferably cover 32 is taut, i.e., in tension, and springs 20 are slightly compressed in the assembled condition of the mattress such that cover 32 holds mesh 28 and border wire 30 firmly in position with respect to springs 20. The relatively fine mesh 28 possesses the additional advantage of helping to prevent cover 32 from becoming snagged or torn by the upper ends of springs 20. In the assembly of mattress 10, springs 20 are fastened to a preassembled frame 12 as described. Cover 32 and a suitable pad (not shown) is placed on a work bench or the like, and the preassembled condition of mesh 28 and border wire 30 is located thereover. The assembled combination of frame 12 and springs 20 is then inverted and placed on mesh 28, and cover 32 is fastened to frame 12 as hereinabove described.

From the foregoing description it will be appreciated that the spring construction and method of assembly provided by the present invention produces a firm and comfortable mattress while significantly reducing the fabrication cost thereof. Although the invention has been described in connection with one specific embodiment thereof, many modifications and variations are contemplated. For example, spacer 18 may be removed from the mattress embodiment illustrated in the drawings to yield a relatively thin box spring which may be used in bunk bends, for example, and yet which retains all of the comfort and support characteristics of a box spring of standard size. Springs 20 need not be provided in a rectilinear row and column array; indeed, the present invention is uniquely adaptable for use with other spring array configurations since the mesh is not fastened to the springs. Thus one size of mesh 28 may be used on all mattresses of similar peripheral size regardless of desired mattress height or grade, an advantage which significantly reduces inventory problems. The mattress illustrated in the drawings embodies generally conical coil springs 20 which are presently preferred in the art for reasons of comfort and support. However, the present invention is equally applicable to and useful with other spring types, such as coiled helical springs of uniform diameter. In accordance with the invention, the diameter of the helical springs in the modification so proposed will be at least equal to and preferably greater than the corresponding spring height to provide firm support in the axial direction and yet inherently resist toppling or bending in the lateral direction, and the upper ends of the springs will be unattached or free-floating with respect to mesh 28 and to each other.

Although the invention has been described in connection with a mattress box spring, it will be appreciated that the invention is not limited thereto and is equally applicable to other furniture coil spring assemblies, such as in sofas or chairs for example. Indeed, the invention is intended to embrace the foregoing and all other alternatives and modifications as fall within the spirit and broad scope of the appended claims.

The invention claimed is:

1. A spring assembly for furniture comprising a plurality of substantially conical coil springs each having a spring height, means attached to ends of said springs of lesser diameter to support said springs such that spring end coils of greater diameter lie in a substantially common plane, and a mesh overlying said spring end coils of greater diameter in said substantially common plane, said end coils of greater diameter being free-floating with respect to said mesh and with respect to each other.

2. The spring assembly set forth in claim 1 wherein the diameter of said end coils of greater diameter is equal to or greater than said spring height.

3. The spring assembly set forth in claim 2 wherein said springs are fabricated of spring wire having a size of at least ten gauge.

4. The spring assembly set forth in claim 2 wherein openings in said mesh are of a size which is substantially less than said diameter of said spring end coils of greater diameter.

5. A mattress box spring comprising a frame, a plurality of coil springs attached to said frame such that an end coil of each said spring lies in a substantially common plane, said coils being unattached to each other in said common plane, a mesh overlying said end coils in said substantially common plane and being unattached to said springs, said mesh including border means around the periphery thereof, and a cover disposed over said mesh and having a periphery draped over said border means and attached to said frame.

6. The mattress box spring set forth in claim 5 wherein the diameter of said spring end coils is equal to or greater than the height of each said spring.

7. The mattress box spring set forth in claim 6 wherein said diameter of said end coils is substantially 50 percent greater than said spring height.

8. The mattress box spring set forth in claim 7 wherein said springs comprise substantially conical springs attached to said frame at ends of said springs of lesser diameter.

9. The mattress box spring set forth in claim 5 wherein said cover is in tension.

10. A spring assembly for furniture comprising a plurality of substantially conical coil springs each having a spring height and a greater end coil diameter substantially 50 percent greater than said spring height, said springs being fabricated of spring wire having a size of at least ten gauge, frame means attached to ends of said springs of lesser diameter to support said springs such that the spring end coils of greater diameter lie in a substantially common plane, a mesh overlying said spring end coils of greater diameter in said substantially common plane and having border means around the periphery thereof, said end coils of greater diameter being free-floating with respect to said mesh and with respect to each other, and a cover disposed over said mesh and having a periphery draped over said border means and attached in tension to said frame means.

* * * * *